United States Patent [19]

Herzog

[11] 3,996,897

[45] Dec. 14, 1976

[54] REHEATER FOR A MOISTURE SEPARATOR REHEATER

[75] Inventor: Josef Herzog, Scotia, N.Y.

[73] Assignee: General Electric Company, Schenectady, N.Y.

[22] Filed: Nov. 21, 1975

[21] Appl. No.: 634,131

[52] U.S. Cl. ..... 122/483; 122/32; 122/174

[51] Int. Cl.[2] ..... F22G 1/00

[58] Field of Search ..... 122/32, 476, 483; 165/158, 174, 176

[56] References Cited

UNITED STATES PATENTS

| | | | |
|---|---|---|---|
| 1,890,429 | 12/1932 | Griswold, Jr. | 122/483 |
| 3,712,272 | 1/1973 | Carnavos et al. | 122/483 |
| 3,734,176 | 5/1973 | Hagnauer | 165/158 |
| 3,759,319 | 9/1973 | Ritland et al. | 165/174 |
| 3,923,009 | 12/1975 | Sohma | 122/483 |

*Primary Examiner*—Kenneth W. Sprague
*Attorney, Agent, or Firm*—John F. Ahern; James W. Mitchell

[57] ABSTRACT

An improved reheater for a moisture separator reheater is provided with a header having first and second baffles disposed therein, dividing the interior of the header into inlet, recirculation and outlet flow chambers. The improved reheater also includes two bundles of U-shaped tubes communicating with the header via a tube sheet. Each tube of the first bundle communicates with the header at the inlet and recirculation chambers. Each tube of the second bundle communicates with the header at the recirculation and outlet flow chambers. This arrangement effects a four-pass recirculation of reheating fluid through the improved reheater. Drains are provided at both the recirculation and outlet flow chambers to prevent condensate flooding and any resulting thermal cycling and rupture of the tubes.

7 Claims, 3 Drawing Figures

REHEATER FOR A MOISTURE SEPARATOR REHEATER

BACKGROUND OF THE INVENTION

1. Field of the Invention

This invention relates to moisture separator reheaters and more particularly to improved reheaters for moisture separator reheaters used in steam turbine power plants.

2. Description of the Prior Art

In large steam turbine power plants where a series of turbine stages are employed, it is often desired to treat the steam exiting one of such turbine stages before that steam enters a succeeding stage. The steam is treated to remove any moisture entrained therein, and to reheat the steam to higher temperatures.

Moisture separator reheaters of various types are well known in the prior art. One example of such moisture separator reheaters is disclosed in U.S. Pat. No. 3,712,272, Carnavos et al, assigned to the assignee of the present invention. The moisture separator reheater disclosed in the Carnavos et al patent employs two reheater sections each of which comprises a bank or bundle of U-shaped tubes extending longitudinally within a pressure-tight shell and including a header for introducing a reheating fluid (steam) to the tubes and withdrawing the fluid (condensate) from the tubes. The Carnavos header is provided with a vertical baffle disposed substantially at the middle thereof dividing the header into inlet and outlet sections. Each tube has one end communicating with the inlet section and another end communicating with the outlet section. In operation, saturated reheating steam is fed to the U-shaped tubes through the inlet section of the header, traverses the tubes, and exits the tubes through the outlet section of the header, any condensate formed in the reheater tubes being drained through a single drain provided in the outlet section.

Under certain operating conditions, substantial quantities of the reheating steam may condense within the lower, thermally, highly loaded U-shaped tubes and collect within the outlet section of the header to the extent that there is a build-up of the condensate therein. Such a build-up of condensate within the header may cause flooding of the tubes. During the operation of the moisture separator reheater, the flooded tubes may purge themselves and may then again become flooded. This cyclic flooding and purging of the tubes causes thermal cycling of the tubes which effects thermal stress concentrations therein, and in time may cause rupturing of those tubes.

One prior art reheater for moisture separator reheaters described in U.S. Pat. No. 3,759,319, Ritland, dealt with the problem of tube flooding by incorporating within a header employed therewith, a mainifold arrangement for recirculating the reheating fluid from one portion of the tubes through another portion of the tubes. In this recirculation process, condensate is deposited within the manifold and drained from the manifold to the header. The condensate is drained from the header through a single drain. However, this solution to the problem necessitates a manifold and additional tubing within the header. The improved reheater of the present invention eliminates the possibility of tube flooding in a more efficient and less complicated manner.

Accordingly, it is an object of the present invention to provide an improved reheater for a moisture separator reheater which simply, efficiently and with a minimum number of added components eliminates tube flooding thereby preventing thermal cycling and possible rupture of any tubes employed therein.

SUMMARY OF THE INVENTION

This and other objects apparent from the following detailed description taken in connection with the appended claims and the accompanying drawings are attained by providing in a moisture separator reheater, an improved reheater comprising a generally cylindrical header having a first vertical baffle disposed therein which divides the header into first recirculation and second, inlet/outlet chambers. A second horizontally sloping baffle disposed transversly with respect to the first baffle divides the second chamber into inlet and outlet flow chambers. Bundles of U-shaped tubes communicate with the header through a flat tube sheet which also forms one wall of the header. Each tube of a first bundle communicates at the ends thereof with the recirculation and inlet flow chambers while each tube of a second bundle communicates at the ends thereof with the recirculation and outlet flow chambers. Drains are provided in the recirculation and outlet flow chambers. Reheating fluid (steam) is introduced into the header at the inlet flow chamber and enters the first bundle of U-shaped tubes communicating therewith. After traversing these tubes, the reheating fluid is exhausted to the first or recirculation chamber, the condensate draining out of the header through the first drain. The reheating fluid is under sufficient pressure to force that fluid into the second bundle of tubes which communicate with the recirculation flow chamber. The reheating fluid traverses these tubes exhausting into the outlet flow chamber which is provided with a second drain for the removal of any further condensate from the header. Thus, what is herein referred to as a four-pass heat exchanger is provided and includes provision for draining condensate approximately midway in the circulation of the reheating fluid and further draining of additional condensate upon exhaust of the reheating fluid from the reheater while maintaining a relatively high pressure of reheating fluid within the tubes.

DESCRIPTION OF THE PREFERRED EMBODIMENT

Figure 1:
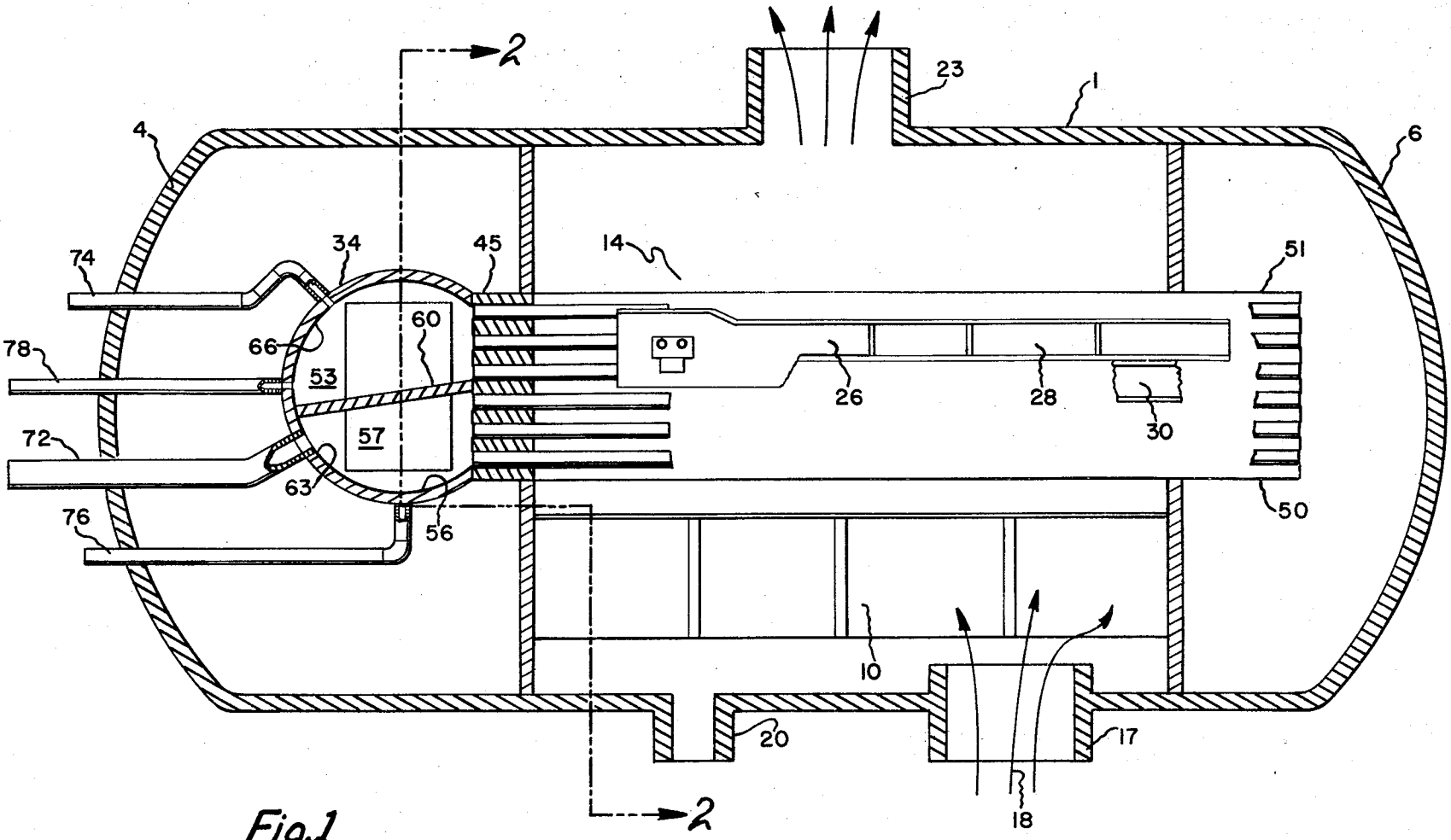
FIG. 1 is a view in partial cross section of a moisture separator reheater of the present invention.
Figure 2:
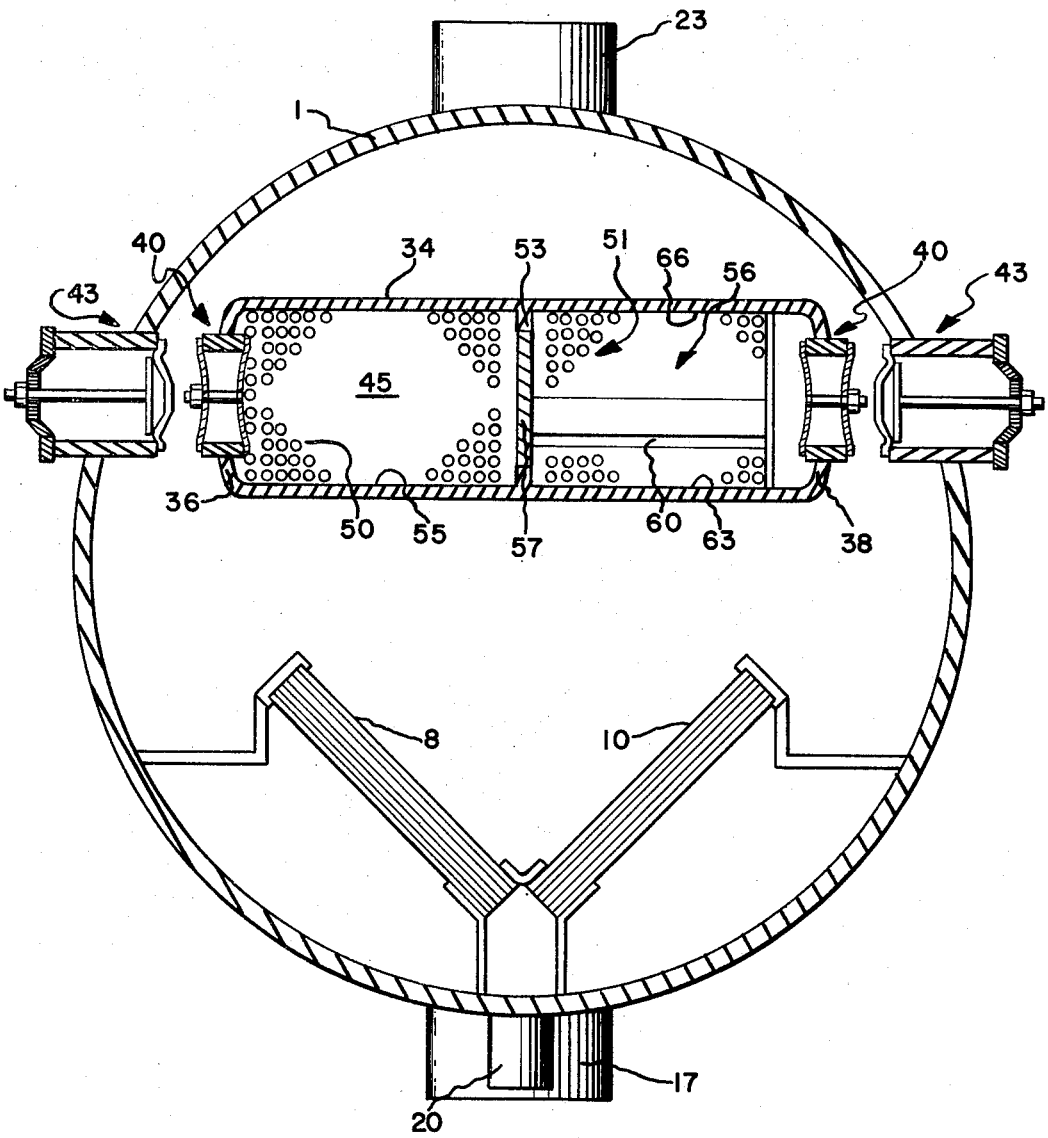
FIG. 2 is a cross-sectional view taken along line 2—2 of FIG. 1.

FIGS. 1 and 2 illustrate in section a moisture separator reheater embodying the present invention. The moisture separator reheater comprises a cylindrical shell 1 capped by generally hemispherical end pieces 4 and 6 to provide a substantially pressure-tight vessel. Disposed within the lower portion of the shell are two banks 8 and 10 of moisture separating elements arranged in a V configuration. Details of the moisture separating elements are not significant with respect to the present invention but they are preferably in the zig-zag or corrugated type well known in the art. The improved reheater 14 of the present invention is disposed above the moisture separator elements within the cylindrical shell 1. Working fluid, usually steam from the exhaust of a turbine stage, is introduced to the moisture separator reheater through a plurality of inlets, one of which is shown at 17. Flow of this working fluid is indicated by the arrows 18 in FIG. 1. Moisture entrained in the flow of working fluid is removed therefrom upon striking banks 8 and 10, drains to the bottom of the shell and is removed therefrom through outlets, one of which is shown at 20. After passing through the banks 8 and 10, the working fluid passes through reheater 14 which heats the working fluid, raising its temperature, before the fluid is exhausted to a successive turbine stage through an outlet 23. Reheater 14 has fixed thereto sliding side rails, one of which is shown broken away at 26. These sliding rails engage stationary rails 28 and 30 fixed to the cylindrical shell for supporting the reheater.

The improved reheater of the present invention comprises a transverse header 34 closed at the ends by caps 36 and 38. Cap 38 is provided with manways 40 which are disposed in alignment with mating manways 43 in cylindrical shell 1 on both ends of header so that the interior of the header may be entered by any maintenance personnel. Header 34 is provided with one flat wall or tube sheet 45 through which first lower and second upper bundles of U-shaped tubes 50 and 51, respectively, communicate with the interior of the header. In total, bundles 50 and 51 include in one embodiment approximately 600 tubes. A first baffle 53 extending in a vertical plane is disposed within the interior of header 34 and divides the header into first recirculation and second input/output chambers 55 and 56, respectively. A door 57 for easy inspection of flow chambers 55 and 56 is disposed in first baffle 53 in alignment with manway 40.

In accordance with the invention, the header is constructed so as to eliminate condensate flooding and the resulting thermal cycling of the tubes. More specifically, provision is made for two separate draining operations in the header 34. This is accomplished by providing in second chamber 56, a second baffle which divides second inlet/outlet chamber 56 into separate inlet and outlet flow chambers. In the particular embodiment disclosed, the second substantially horizontal, slightly sloped baffle 60 disposed within second chamber 56 extends in a transverse direction with respect to first vertical baffle 53. Second sloped baffle 60 is fixed to header 34, tube sheet 45, first baffle 53 and cap 38 thereby dividing second chamber 56 into a lower inlet flow chamber 63 and an upper outlet flow chamber 66. Second baffle 60 is sloped downwardly to direct condensate toward a drain for draining the condensate from the tubes of bundle 51 away from the outlet chamber 66.

Figure 3:
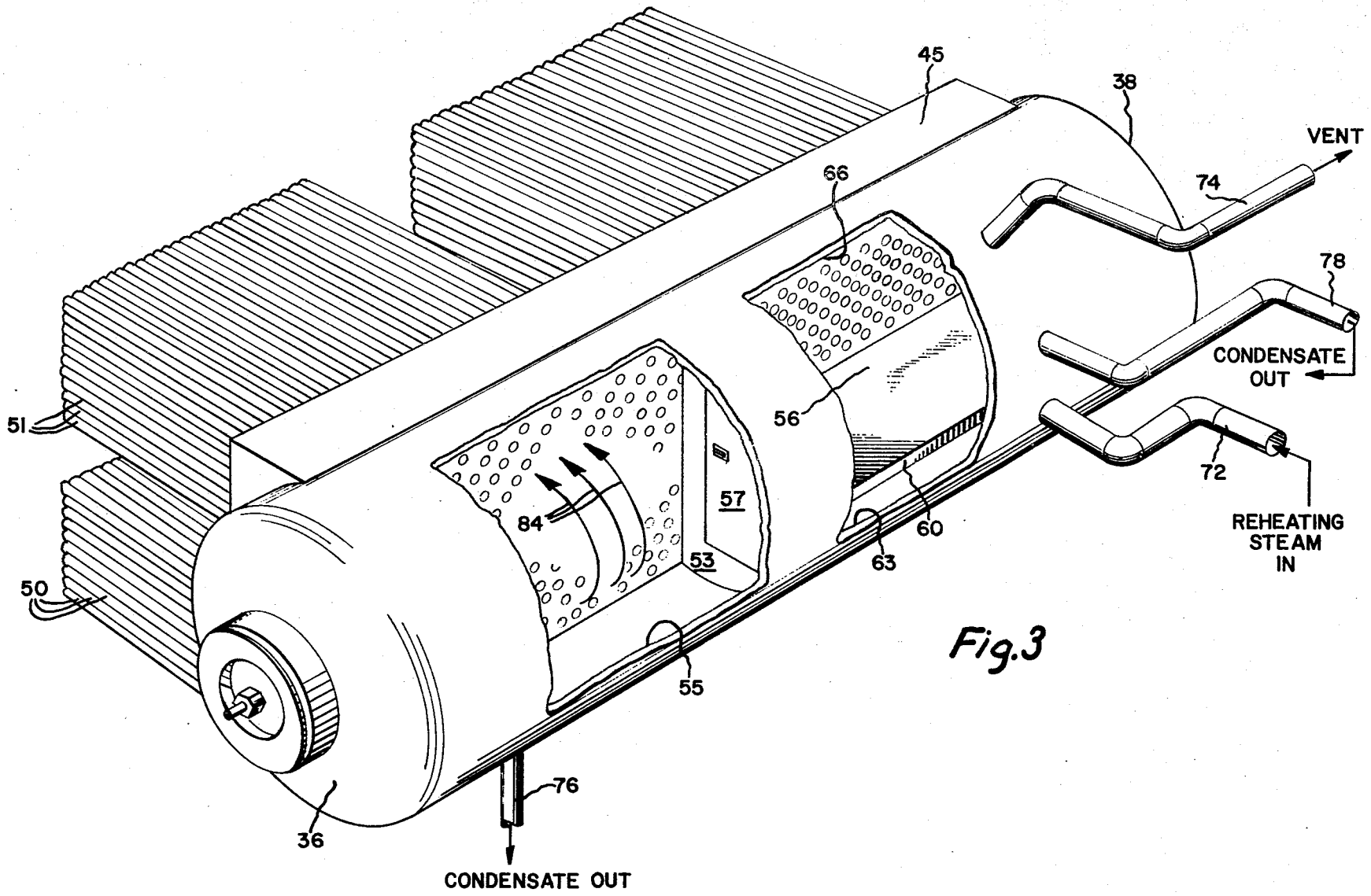
FIG. 3 is a perspective view of the improved reheater of the present invention broken away to show the details thereof.

Referring particularly to FIG. 3, it can be seen that each of the tubes communicates with header 34 on both sides of first baffle 53. The first bundle 50 of tubes communicates with inlet flow chamber 63 and the lower portion of first or recirculation flow chamber 55. The second bundle 51 of tubes communicates with the upper portion of recirculation flow chamber 55 and outlet flow chamber 66 providing, with the first bundle of tubes, a four-pass heat exchange arrangement.

Reheating fluid is introduced to inlet flow chamber 63 through an inlet line 72. Any noncondensable gases contained in the reheating fluid exits the improved reheater of the present invention through vent pipe 74. To prevent the flooding of any of the U-shaped tubes, first and second drains 76 and 78, respectively, are provided. First drain 76 comprises a tube which communicates with a lower portion of recirculation flow chamber 55 and removes any condensate from that chamber approximately midway in the circulation of the reheating fluid through the four-pass arrangement provided by the improved reheater of the present invention. The second drain 78 comprises a tube which communicates with a lower portion of outlet flow chamber 66 at the lower edge of second baffle 60 and removes any condensate from that chamber at the completion of the four-pass circulation of reheating fluid through the reheater.

In operation, reheating fluid or steam is introduced to inlet flow chamber 63 through inlet line 72. The reheating fluid enters inlet flow chamber 63 and due to its pressure is forced into the first lower bundle 50 of U-shaped tubes communicating therewith. The reheating fluid traverses the first bundle 50 of tubes and exhausts to the lower portion of recirculation flow chamber 55. Any of the reheating fluid which has condensed within first bundle is drained from the header by first drain 76 so as to eliminate flooding of this bundle of tubes. As indicated by arrows 84 in FIG. 3, after exiting the first bundle 50 of U-shaped tubes the reheating fluid having traversed only a portion of the total number of tubes and therefore, being at a relatively high pressure, enters the second bundle 51 of the U-shaped tubes where that bundle communicates with the upper portion of recirculation flow chamber 55. The reheating fluid traverses the length of the second bundle of U-shaped tubes and exhausts to the outlet flow chamber 66 where second drain 78 removes any condensate in that chamber thereby eliminating flooding of the second bundle of tubes. Therefore, in the improved reheater of the present invention two draining operations are accomplished, one in the recirculation flow chamber and the other in the outlet flow chamber. The provision of two draining operations in the reheater of the present invention prevents any buildup of condensate within the header. Moreover, since the reheating fluid is introduced to the improved reheater through only a portion of the tubes (those in the first bundle), the flow through the first bundle is at a relatively high pressure assisting in preventing the buildup of condensate within the tubes. Any noncondensable gas which exhausts into the outlet flow chamber is vented out of the reheater by vent pipe 78.

It can be seen that the improved reheater of the present invention eliminates the possibility of any flooding of any heat exchange tubes employed therein and therefore prevents the rupturing of the tubes under the influence of thermal cycling which accompanies this flooding and any subsequent purgng of condensed reheating fluid from the tubes. Furthermore, this is accomplished without employing complex manifold arrangements shown in the prior art or requiring two separate headers. Rather, the prevention of tube flooding by the present invention is accomplished in a simple and economical manner with a minimal number of additional components.

While there has been shown and described a specific embodiment of the improved reheater of the present invention for a combined moisture separator and reheater, it will be apparent to those skilled in the art that modifications may be made without departing from the substance of this invention and it is intended by the appended claims to cover such modifications as come within the spirit and scope of this invention.

What is claimed is:

1. A moisture separator steam reheater comprising:
a. a substantially pressure-tight vessel;
b. means to admit cool moisture laden steam to said vessel;
c. means for separating entrained moisture from said steam;
d. means for elevating the temperature of said moisture separated steam and including,
$d_1$. an array of a plurality of re-entrant tubes in a substantially U-shaped configuration through which array said steam passes in heat-exchanging relationship;
$d_2$. a header connected to both ends of said plurality of re-entrant tubes;
$d_3$. means for admitting heating steam to said header and for removing the cooled residue therefrom;
$d_4$. baffle means within said header operative to cause all of the heating steam passing from said steam admitting and removing means to pass twice in a U-shaped path through selected ones of said plurality of tubes;
e. drain means for removing moisture condensed from said heating steam from said header after each pass through said tubes; and
f. means for exiting heated, moisture separated steam from said vessel.

2. The apparatus of claim 1 wherein said baffle means includes a first vertical baffle separating said header into a first recirculation chamber and a second inlet/outlet chamber, and a second substantially horizontal baffle separating said inlet/outlet chamber into an inlet chamber and an outlet chamber.

3. The apparatus of claim 2 wherein said drain means comprises an outlet drain at a low point of said intermediate chamber and an outlet drain at a low point of said outlet chamber.

4. A moisture separator reheater comprising:
a. a substantially pressure-tight vessel;
b. an entrance port in said vessel for admitting relatively cool steam containing entrained moisture to said vessel;
c. means for removing entrained moisture from said admitted steam;
d. at least one array of substantially U-shaped heat-exchange tubes arranged laterally across the interior of said vessel and arranged in heat-exchange relationship with the path of said admitted steam after the removal of moisture therefrom;
e. a header receiving both ends of each of the tubes constituting said array and adapted to serve as means to pass heating steam into said tubes and to remove the residue thereof therefrom;
f. said header comprising a generally cylindrical hollow body having one substantially flat surface adapted to receive the ends of said tubes;
g. a first inlet chamber located at a first end of said header and adapted to admit heating steam to one end of approximately half of said tubes;
h. a recirculation flow chamber located at a second opposite end of said header and adapted to receive heater steam and moisture from the other end of said approximate half of said tubes and admit said steam into the other end of the remaining ones of said tubes and to collect said moisture for draining off;
i. an outlet chamber located at said first end of said header vertically above said first inlet chamber and adapted to receive from said first end of said remaining ones of said tubes the remainder of said heating steam and to collect moisture from said tubes for draining off said moisture;
j. said inlet and said outlet chambers being separated by a substantially horizontal, slightly sloped baffle therebetween and said recirculation flow chamber being separated from said inlet and outlet chambers by a vertical baffle which divided said header in two substantially equal halves, and;
k. means for exiting hot, relatively dry steam from said vessel.

5. A moisture separator reheater including an improved reheater comprising:
a. a header divided into inlet, outlet, and recirculation flow chambers;
b. a first bundle of U-shaped tubes communicating with said header, each tube of said first bundle communicating at one end with said inlet flow chamber at the opposite end with said recirculation flow chamber;
c. a first drain in communication with said recirculation flow chamber for removing condensate from said recirculation flow chamber and said first bundle of U-shaped tubes;
d. a second bundle of U-shaped tubes communicating with said header, each tube of said second bundle communicating at one end with said recirculation flow chamber and at the opposite end with said outlet flow chamber; and
e. a second drain in communication with said outlet flow chamber for removing condensate from said outlet flow chamber and said second bundle of U-shaped tubes.

6. A moisture separator reheater including an improved reheater comprising:
a. a header;
b. a vertical baffle disposed within said header and dividing said header into first recirculation flow and second inlet/outlet chambers;
c. a second baffle disposed transversely to said first vertical baffle, said second baffle dividing said second chamber into inlet and outlet flow chambers;
d. a first bundle of U-shaped tubes communicating with said header, each tube of said first bundle communicating at one end with said inlet flow chamber and at the opposite end with said first chamber;
e. a first drain in communication with said recirculation flow chamber for removing condensate from said first chamber and said first bundle of U-shaped tubes;
f. a second bundle of U-shaped tubes communicating with said header, each tube of said second bundle communicating at one end with said outlet flow chamber and at the opposite end with said first chamber; and
g. a second drain in communication with said outlet flow chamber for removing condensate from said outlet flow chamber and said second bundle of U-shaped tubes.

7. The improvement of claim 5, wherein said first drain is disposed in a lower portion of said recirculation flow chamber, said second drain is disposed in the lower portion of said outlet flow chamber and said second baffle is sloped toward said second drain for directing condensate toward said second drain.

* * * * *